US011578846B2

(12) United States Patent
Russikoff et al.

(10) Patent No.: US 11,578,846 B2
(45) Date of Patent: Feb. 14, 2023

(54) DECORATIVE LIGHTING SYSTEM WITH IMPROVED SUPPORT FRAMEWORK ASSEMBLY

(71) Applicant: TwinkleTrak LLC, Doylestown, PA (US)

(72) Inventors: Ronald K. Russikoff, Philadelphia, PA (US); Dana Russikoff, Philadelphia, PA (US)

(73) Assignee: TwinkleTrak LLC, Doylestown, PA (US)

( * ) Notice: Subject to any disclaimer, the term of this patent is extended or adjusted under 35 U.S.C. 154(b) by 0 days.

(21) Appl. No.: 17/803,313

(22) Filed: May 5, 2022

(65) Prior Publication Data

US 2022/0357000 A1 Nov. 10, 2022

Related U.S. Application Data

(60) Provisional application No. 63/258,513, filed on May 7, 2021.

(51) Int. Cl.
*F21S 4/28* (2016.01)
*F21V 21/005* (2006.01)
(Continued)

(52) U.S. Cl.
CPC ..... *F21S 4/28* (2016.01); *F21V 21/005* (2013.01); *F21V 21/047* (2013.01);
(Continued)

(58) Field of Classification Search
CPC .. F21V 2131/405; F21V 21/30; F21V 21/047; F21V 21/005; F21S 4/28
See application file for complete search history.

(56) References Cited

U.S. PATENT DOCUMENTS 5,700,083 A * 12/1997 Boechel ..... F21V 21/088 362/249.14
6,179,258 B1 * 1/2001 Dell'Aquila ..... F21S 4/20 248/314
(Continued)

*Primary Examiner* — Anabel Ton
(74) *Attorney, Agent, or Firm* — Armand M. Vozzo, Jr.

(57) ABSTRACT

An improved decorative lighting system constructed having a support framework assembly for mounting decorative lights in connection with a window frame. The support framework assembly comprises a plurality of tubular track members, each formed having a slotted chamber section extending the length of the track member with a squared outer edge formed along either side at the base of the chamber to provide a substantially flat planar surface along the base of the track member. A plurality of articulating end clips are formed to engage each track member and interconnect with another to join the track members in a substantially rectangular configuration adjustable to conform to the shape of the window frame. A plurality of specially configured light mounting clips are formed to press-fit and slide along the flat perimeter surface of the track members and hold the decorative lights in selected positions along the track members. Ring members included upon selected ones of the articulating end clips are used and positioned in upper corners of the framework assembly to engage conventional hooks or tabs secured to the window frame and facilitate the mounting of the framework assembly and its removal and storage when desired. The articulating end clips further allow the complete support framework assembly to fold and store more easily.

18 Claims, 9 Drawing Sheets

(51) Int. Cl.

| | |
|---|---|
| ***F21V 21/04*** | (2006.01) |
| ***F21V 21/088*** | (2006.01) |
| ***F21V 21/30*** | (2006.01) |
| ***F21V 33/00*** | (2006.01) |
| *F21W 131/405* | (2006.01) |
| *F21V 23/00* | (2015.01) |

(52) U.S. Cl.
CPC ..... *F21V 21/088* (2013.01); *F21V 21/30* (2013.01); *F21V 33/006* (2013.01); *F21V 23/002* (2013.01); *F21W 2131/405* (2013.01)

(56) References Cited

U.S. PATENT DOCUMENTS

| | | | | |
|---|---|---|---|---|
| 7,160,000 | B2 * | 1/2007 | Eldridge | F21V 17/007 360/220 |
| 9,915,401 | B2 * | 3/2018 | Russikoff | F21S 4/28 |
| 2019/0211983 | A1 * | 7/2019 | Shine | F21V 15/015 |

* cited by examiner

DECORATIVE LIGHTING SYSTEM WITH IMPROVED SUPPORT FRAMEWORK ASSEMBLY

CROSS-REFERENCE TO RELATED APPLICATION

This application claims the benefit of U.S. Provisional Application Ser. No. 63/258,513 filed May 7, 2021 for a Decorative Lighting System with Improved Support Framework Assembly.

BACKGROUND OF THE INVENTION

The present invention relates to window-mounted systems for installing decorative lighting and, more particularly, to a decorative lighting system for windows that includes an improved support framework assembly for mounting the system within a window frame with greater ease and further affording easy removal and storage when desired.

Throughout the United States and elsewhere, the practice of displaying decorative lighting on homes, apartments and other dwelling units at holiday times has become increasingly wide spread. Traditionally, this practice of displaying holiday lights was most often implemented during the Christmas season, but recently, has become a more frequent and almost year-round exercise in enhancing other holiday celebrations like Valentine's Day, St. Patrick's Day, Easter, Halloween and Thanksgiving. Typically, these holiday light displays utilize a plurality of pre-wired lights of white or a variety of colors in differing lengths or "strings" that are attached to structural elements of the home or other dwelling unit to achieve a decorative effect, with the strings of lights being secured beneath overhanging eaves and around gables, and positioned to outline architectural features of the homes, both inside and outside, such as doorways and windows.

Window frames are especially desirable for displaying holiday lights but not generally suitable for doing so. Traditional methods of displaying holiday lights in a window have involved the use of tape, tacks, nails, suction cups, or other fasteners to hold the light strings in place within the window frame which often damage the area surrounding the window or leave unsightly marks on the window glass. Makeshift mounting systems have been used for years and although the lights are quite attractive when installed, the installation of one string of holiday lights in a window is usually a painstaking activity, with the process of completing light installation on a group of windows, as is often the case, inevitably taking a significant amount of time. Since neither the light strings nor the windows are designed with the idea of simply mounting the lights into the window frames themselves, framework systems formed and adapted to fit standard rectangular window frames have been devised in the prior art to ease the task of light installation upon a given window and reduce the time involved to do so. Many of these prior art framework systems are designed having a support framework made of rigid channels or tubular members that are provided with individual compartments, retaining clips or fitted holes adapted to hold separate lights of a continuous string in a set position. Examples of this type of characteristic framework system are shown and described in U.S. Pat. No. 4,821,158 to Mitten; U.S. Pat. No. 5,700,083 to Boechel; U.S. Pat. No. 5,791,762 to Wroblewski; U.S. Pat. No. 5,954,419 to D'Angelo; and U.S. Pat. No. 6,179,258 to Dell'Aquila. Another type of prior art mounting device used for decorative lighting is formed from an assembly of hollow tubes interconnected by a series of elbows, with the tubes being slit to allow a continuous string of lights to be held in connection with the tubes around the window perimeter at adjustable locations. An example of this such type of prior art device designed to display a continuous light string upon a door frame or window frame without means for set positioning of individual lights is found in U.S. Pat. No. 8,425,075 to Falat et al.

More recently developed and presented in U.S. Pat. No. 9,915,401 is a Mounting System and Associated Kit for Installing Decorative Lights that describes a support framework assembly of separate tubular track members having slotted openings therein to hold the lights and intermediate wiring inserted therein, with the respective track members being joined together and mounted to the window using plug-like L-shaped and T-shaped connectors designed to press-fit and engage adjacent track members and the window frame in a somewhat rigid rectangular form conforming with the standard window frame. While this prior art patented system does provide an effective installation of decorative lighting within a standard window frame, some limitations have been found with the rigid form of the resulting framework and its mounting and with maintaining desired placement of the lights in the slotted openings.

While these and other prior art lighting mounting systems give all indications to work satisfactorily in providing a decorative light display for window frames, they have not been widely accepted and used by the general public due to certain limitations in the ability to fabricate, manufacture and assemble their support framework as well as difficulties in their mounting installations. As a result, they have not been generally affordable and easy to use by the general public. Furthermore, these prior art window frame lighting systems have also been limited to the extent that a user can adjust the set positioning of the lights in the resulting display to suit the desire and preference of the user and better complement the size and shape of the window to optimize the decorative effect. Accordingly, there is a genuine need for an improved decorative lighting system that better adapts to window frames of various shapes and sizes with a greater ease and flexibility of installation and that can provide the user with better adjustment of the lighting positions than heretofore afforded by the prior art.

SUMMARY OF THE INVENTION

Accordingly, it is a general purpose and object of the present invention to provide an improved decorative lighting system for displaying an arrangement of decorative lights in and around windows of different sizes and configurations in a customized manner with maximum aesthetic appeal.

A more particular object of the present invention is to provide an improved decorative lighting system for customized mounting within a window frame that is better constructed and easier to assemble and mount than prior art systems heretofore developed.

Another object of the present invention is to provide a window-mounted decorative lighting system constructed and assembled with an improved supporting framework that is more easily installed into any window frame and can be more readily removed without damaging the frame and stored with ease for subsequent installation.

Still another object of the present invention is to provide a decorative lighting system with improved supporting framework for window mounting that can more flexibly adjust to different shapes and more easily adjust the desired positioning of the lights in the resulting display to optimize the decorative effect and better complement the size and shape of the associated window.

A still further object of the present invention is to provide an improved window-mounted decorative lighting system that is inexpensive to manufacture and economical to produce, and capable of maintaining reliability of performance over extended periods of usage.

Briefly, these and other objects of the present invention are accomplished by a decorative lighting system constructed having an improved supporting framework assembly for mounting decorative lights in connection with a window frame. The supporting framework assembly comprises a plurality of tubular track members, each formed having a slotted chamber section extending the length of the track member with a squared outer edge formed along either side at the base of the chamber to provide a substantially flat planar surface along the base of the track member. A plurality of articulating end clips are formed to engage each track member and interconnect with another to join the track members in a substantially rectangular configuration adjustable to conform to the shape of the window frame. A plurality of specially configured light mounting clips are formed to press-fit and slide along the flat perimeter surface of the track members and hold the decorative lights in selected positions along the track members. Ring members included upon selected ones of the articulating end clips are used and positioned in upper corners of the framework assembly to engage conventional hooks or tabs secured to the window frame and facilitate the mounting of the framework assembly and its removal and storage when desired. The articulating end clips further allow the complete supporting framework assembly to fold and store more easily.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DESCRIPTION OF THE INVENTION

Figure 1:
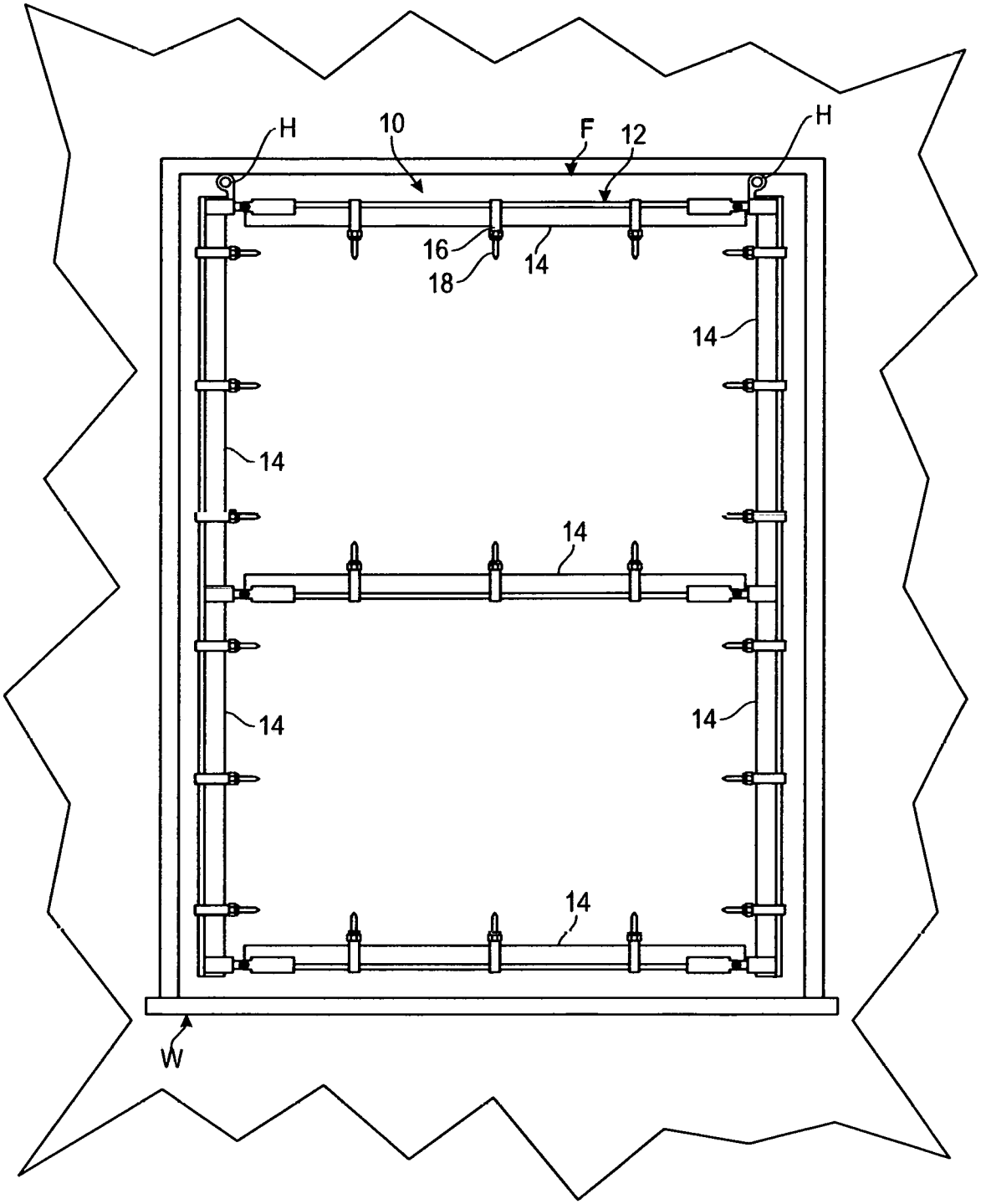
FIG. 1 is a front elevation view of a preferred embodiment of the decorative lighting system with its support framework assembly installed within a rectangular window frame in accordance with the present invention.

The following serves to describe a preferred embodiment of the present invention and the best presently contemplated mode of its production and practice. This description is further made for the purpose of illustrating the general principles of the invention but should not be taken in a limiting sense, the scope of the invention being best determined by reference to any associated claims.

Referring to the drawings, the following is a list of structural components of the present decorative lighting system, generally designated 10, and those associated structural elements shown employed in connection with the present invention:

10 decorative lighting system;
12 support framework assembly;
14 tubular track member;
14*a* track member chamber;
14*b* slotted opening;
14*c* squared bottom edge;
16 light mounting clip (preferred);
16*a* light mounting clip head;
16*b* light mounting clip base;
16*c* light mounting clip neck;
16*d* light mounting clip pad;
18 light elements;
19 electrical wiring;
20 articulating end clip assembly;
20*a* end clip;
20*b* ring element;
20*c* clamp fitting;
20*d* intermediate pivotal joint;
22 hinged coupler assembly;
22*a* first coupler fitting;
22*b* second coupler fitting;
22*c* hinge joint;
26 light mounting clip (alternate);
26*a* light mounting clip head;
26*b* light mounting clip base;
26*c* light mounting clip neck;
26*d* light mounting clip pad;
H mounting hook or tab;
F window frame; and
W window.

Referring initially to FIG. 1, the present decorative lighting system 10 is shown mounted upon a typical rectangular window W carrying a plurality of individual decorative light elements 18 positioned along tubular track members 14 upon respective light mounting clips 16. Using a pair of ring elements 20*b* projecting upward from both sides of the support framework assembly 12, the present decorative lighting system 10 and its support framework assembly is hung in place within the frame F of the window W upon a pair of conventional hooks or tabs H fastened to the window in its upper corners.

In accordance with the present invention, the decorative lighting system 10 comprises the support framework assembly 12 made up of a plurality of separate tubular track members 14, each intended to support one or more of the light elements 18 along the length of the track member. In the embodiment of FIG. 1, the tubular track members 14 in the support framework assembly 12 are relatively rigid in their form, preferably made of a plastic material in molded extrusions cut in varied lengths. On the perimeter of the support frame assembly 12, respective ones of the tubular track members 14 are disposed with the slotted opening 14*b* facing inward and the flat planar surface at the base of the tubular tack member being outwardly facing to align in proximity with the interior of the window frame F. The tubular track members 14 transversely disposed within the support framework assembly 12 between the track members on the perimeter may be positioned so that the slotted opening 14*b* and flat planar surface on the opposite side are facing in either upward or downward direction across the width of the window frame.

Figure 2:
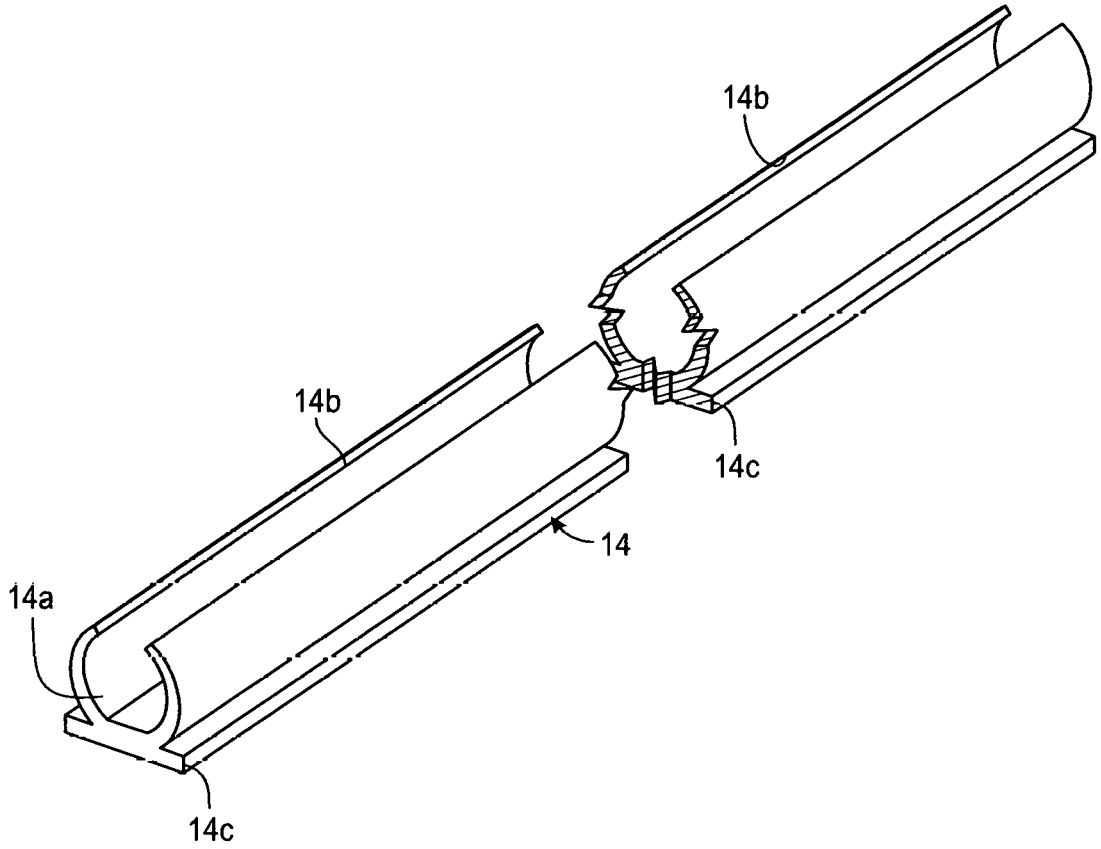
FIG. 2 is a longitudinal perspective view of a section of an exemplary tubular track member used in the support framework assembly of the present decorative lighting system shown in FIG. 1.
Figure 3:
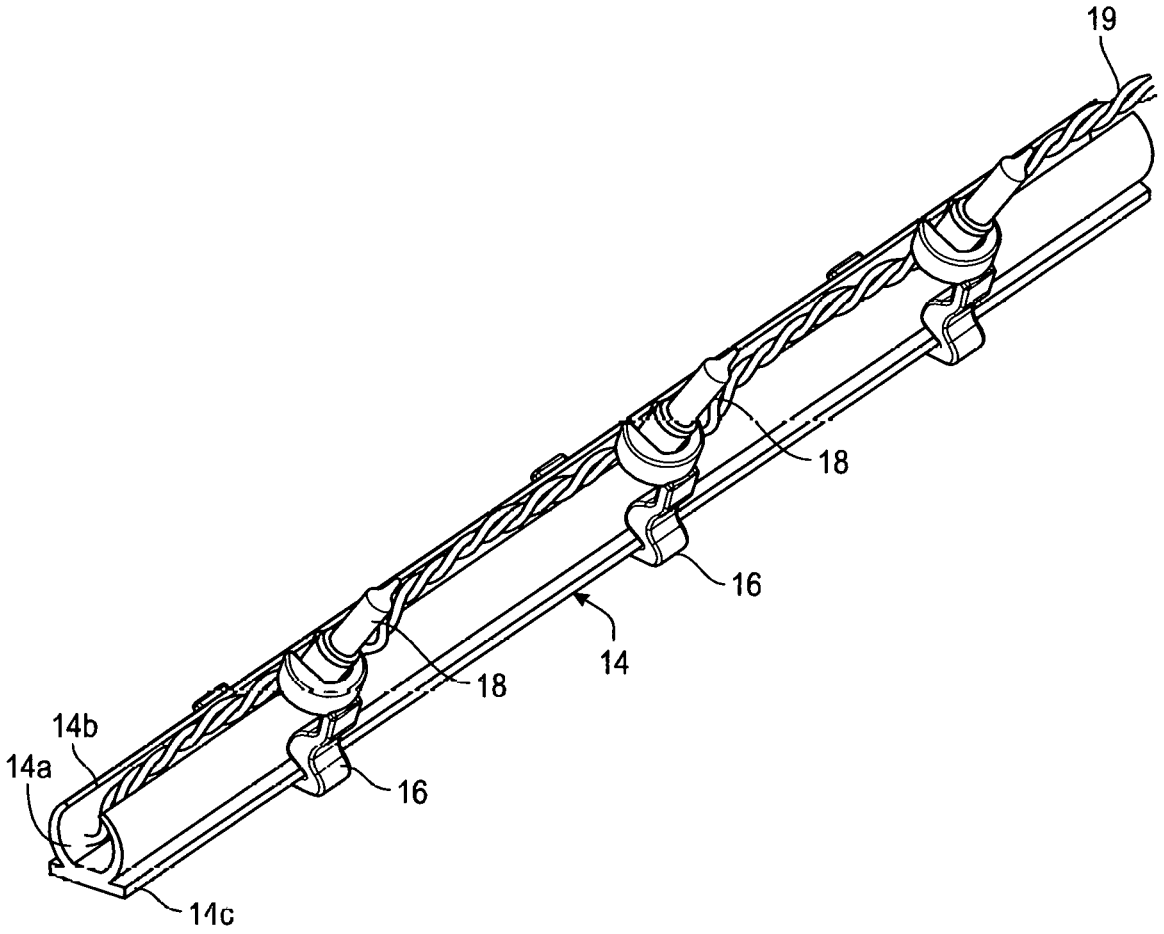
FIG. 3 is a longitudinal perspective view of a section of tubular track member with a plurality of lights mounted thereon and intermediate electrical wiring contained in accordance with the present invention.

Referring now to FIGS. 2 and 3 in conjunction with FIG. 1, each of the tubular track members 14 is formed having a longitudinal chamber 14*a* formed along its length with a slotted opening 14*b* formed atop the chamber. The width of the slotted opening 14*b* is sufficient in its dimension to insert into the chamber 14*a* the lengths of electrical wiring 19 connected between respective lights 18 as seen in FIG. 3. Each tubular track member 14 is further formed having a squared outer edge 14*c* along either side of the chamber 14*a* at the base thereof to support a substantially flat planar surface along the base of the track member and provide a firm edge surface for engagement by the respective forms of the light mounting clips 16 and articulating end clip assembly 20 as described in greater detail below. As best seen in FIG. 3, the outer edges 14*c* are formed having a squared cross-section along both sides of the base of track member 14 to support fitted transverse engagement by the base of the light mounting clips 16 on both sides that serve to maintain the positioned placement of the respective lights 18 held by the mounting clips along the track member.

Figure 4A:
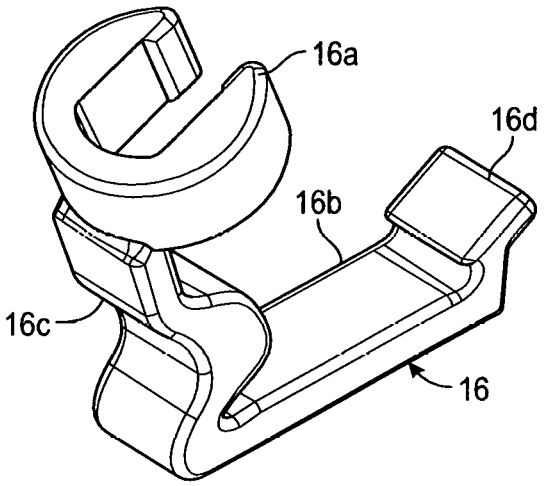
FIGS. 4A and 4B are respective views each in perspective of a preferred and alternate form of light mounting clip used in the support framework assembly of the present invention.
Figure 4B:
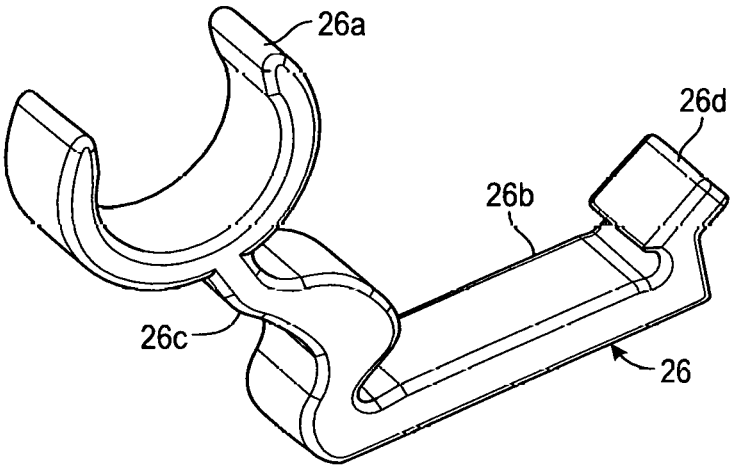

Referring now to FIGS. 4A and 4B, preferred and alternate forms of light mounting clips 16 and 26 are presented, the primary difference being with respect to the light-holding portion of each form. Each light mounting clip 16 and 26 is made as an integrated unit member and preferably made from a plastic material extruded in form. Each of the light mounting clips 16 and 26 are similarly formed to engage the base of the track member 14 transversely with a snap fit that may further be slid along the track member if needed with a slight press. This fitted engagement will accommodate and maintain proper positioning of the light mounting clips 16 and 26 on both horizontally and vertically mounted track members 14.

Both preferred and alternate light mounting clips 16 and 26 are formed to include a base section 16*b*, 26*b* having a relatively thin and flat surface extending between a neck section 16*c*, 26*c* rising from the base section at the forward end of each clip and a pad section 16*d*, 26*d* rising at an inclined angle at the rearward end of each clip. The dimensional extension of the respective base sections 16*b*, 26*b* between the neck sections 16*c*, 26*c* and the pad sections 16*d*, 26*d* should be substantially the same as the transverse width of the tubular track member 16 at its base. The neck portions 16*c*, 26*c* rise from the base sections 16*b* 26*b* in an arcuate fashion providing a bow or bulge-like contour that extends rearward above the base sections to leave an interstitial space between the contour and the base section that will serve to engage the squared outer edge 14*c* along the base of track member 14. A similar and equivalent interstitial space is provided between the pad sections 16*d*, 26*d* and the base sections 16*b*, 26*b* at the rearward end of the clip and thus provide for the complete transverse engagement between the base of the light mounting clips 16, 26 and the outer edges 14*c* of the base of track member 14. Formed at the top of the neck sections 16*c*, 26*c* on each of the light mounting clips 16 and 26 are respective head sections 16*a*, 26*a* which differ in their cross-sectional configurations and their projections for holding the respective light elements 18. While both head sections 16*a* and 26*a* are formed having open circular configurations in which the lights 18 may be inserted and held therein, head section 16*a* of the preferred light mounting clip 16 is formed having a thicker cross-sectional body designed to clamp upon the body of the smaller more traditional decorative lights currently commercially available and project the light upward and outward from the clip engaged upon track member 14. The alternate clip head section 26*a* is formed having a wider, more ring-like cross-section and is intended to hold larger, more bulb-like decorative lights, such as commercially available C6 decorative lights and so-called "rope lights" used in decorating, and serves to hold those larger light elements in place alongside the engaged track member 14 directed in either axial direction.

Figure 5:
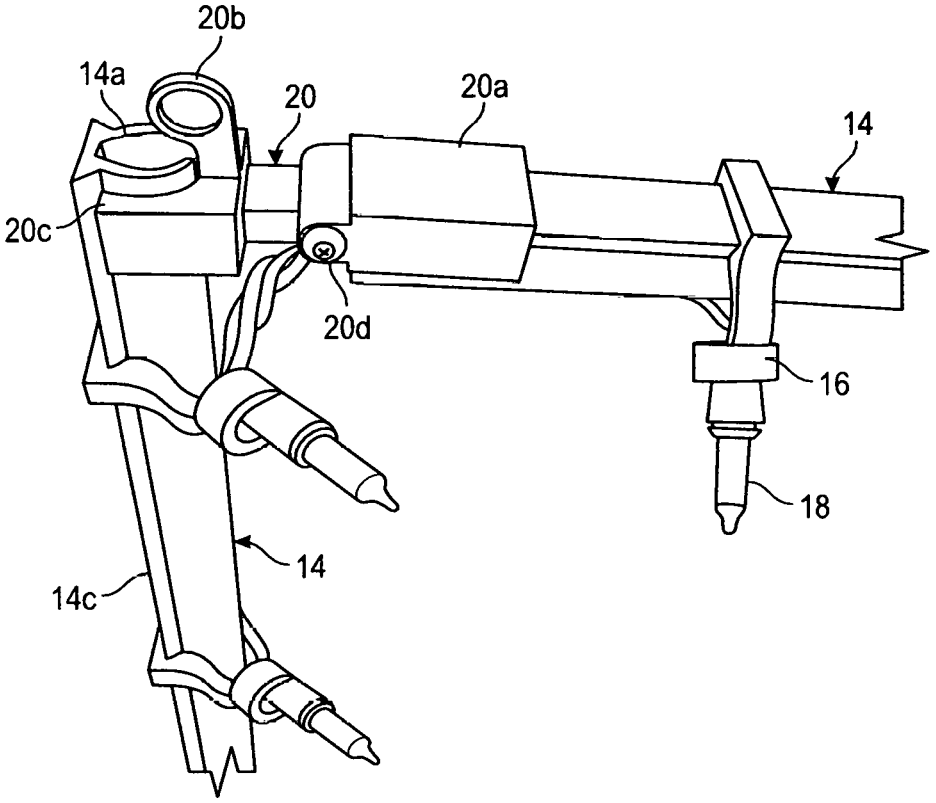
FIG. 5 is an enlarged perspective view of the upper left corner of the support framework assembly shown in FIG. 1.
Figure 6:
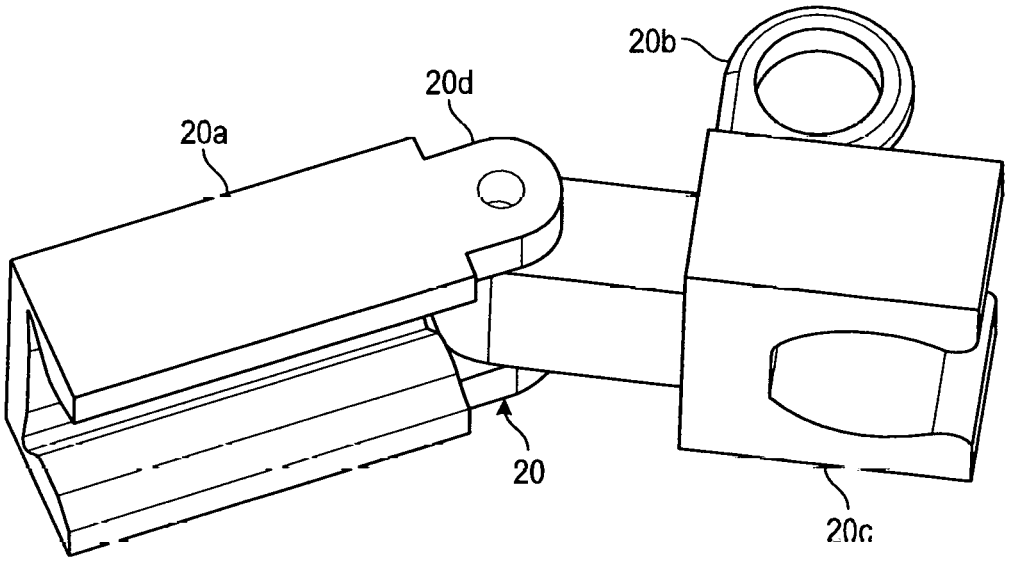
FIG. 6 is a perspective view of the articulating end clip assembly seen in FIG. 5.
Figure 7:
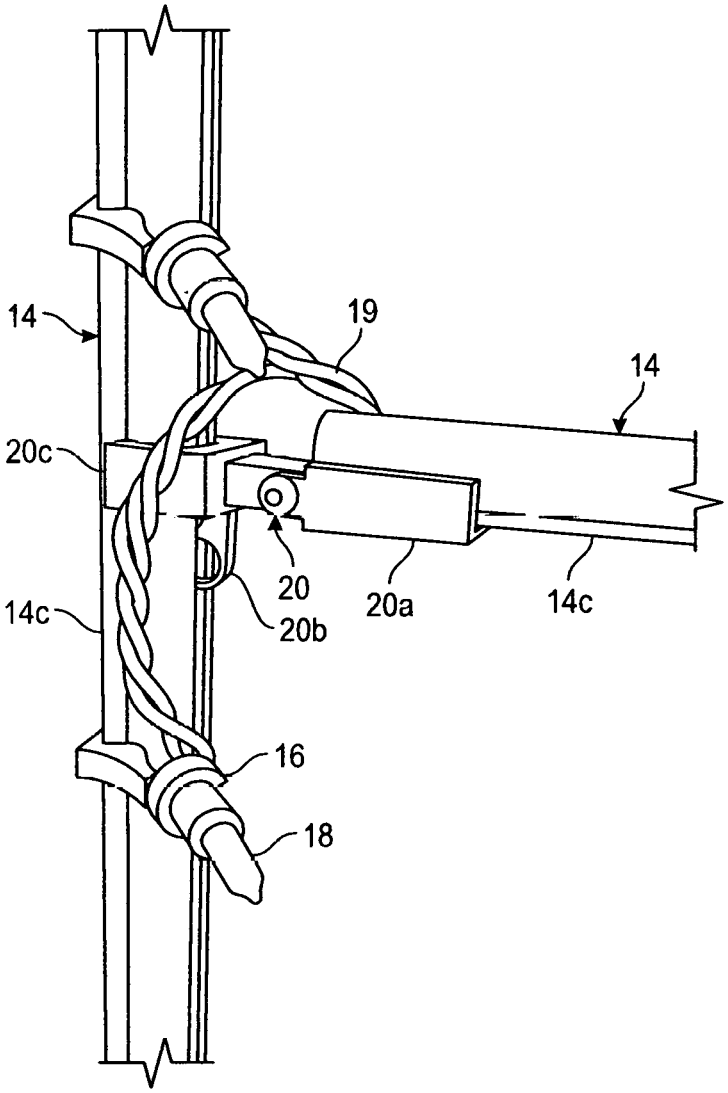
FIG. 7 is an enlarged perspective view of the middle region of the support framework assembly, here being on the left side thereof shown in FIG. 1.

Referring now to FIGS. 5-8, articulating end clip assemblies 20 are used in accordance with the present invention to join and flexibly interconnect the respective tubular track members 14 disposed horizontally and vertically in the support framework assembly 10. As seen in FIGS. 5 and 7, each articulating end clip assembly 20 is constructed and formed to engage the base surface of the tubular track member 14 on one end and further engage the upper tubular chamber 14*a* of the immediately proximate track member at the other end of the clip assembly. This manner of engagement effected by the articulating end clip assembly 20 works similarly in interconnecting tubular track members 14 whether positioned horizontally at the top or bottom of the support framework assembly 12 or at an intermediate horizontal position in the framework assembly.

Figure 8:
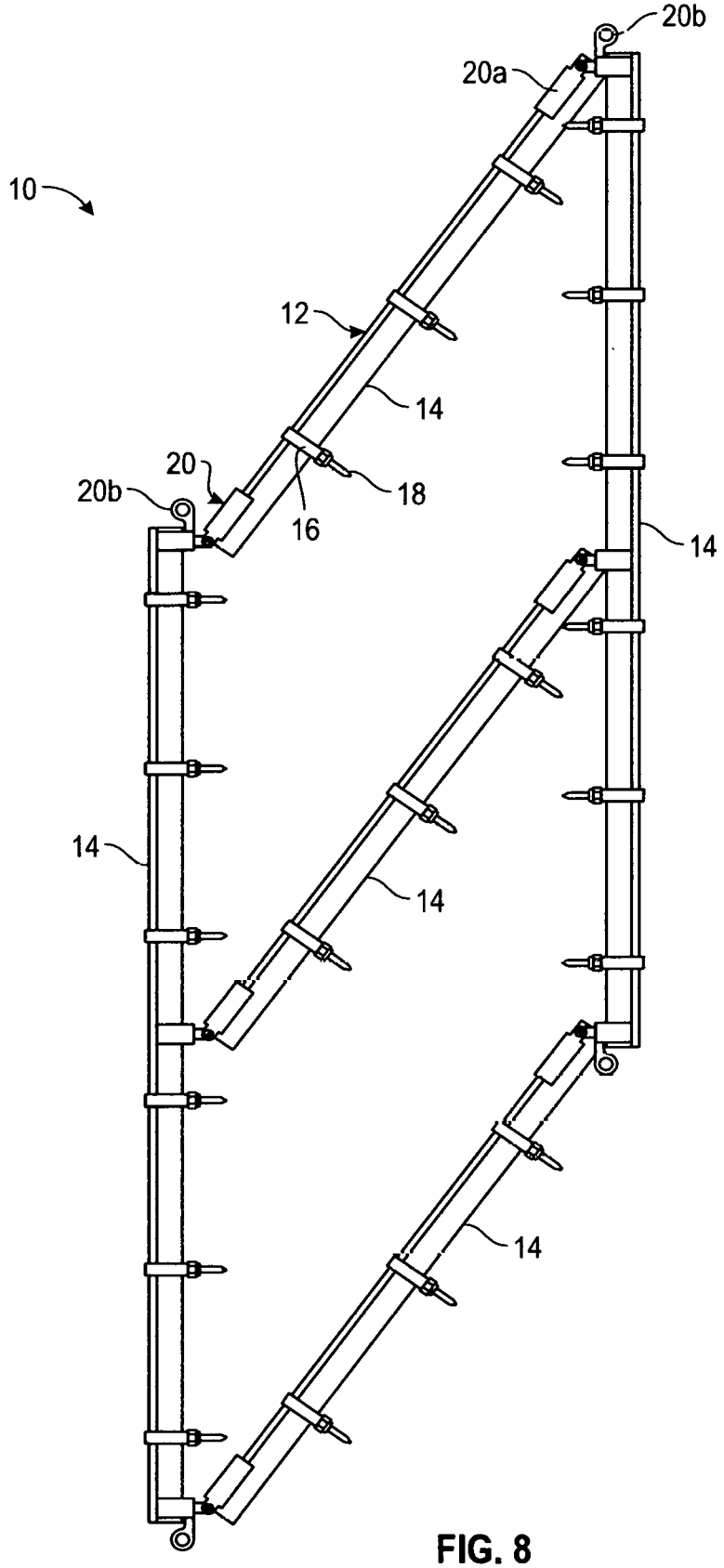
FIG. 8 is an illustration of the support framework assembly of the present invention as it may be placed in a folded condition.

As seen more closely in FIG. 6, the articulating end clip assembly 20 comprises an end clip member 20*a* having an open rectangular cross-section configured to engage the base surface of tubular track member 14, a clamp fitting 20*c* formed having an open circular cavity at a distal end thereof configured to engage the upper tubular chamber 14*a*, and an intermediate pivotal joint 20*b* made between the clip member and the clamp fitting, the pivotal joint allowing each to rotate relative to the other in the same plane. The open rectangular cross-section of the end clip member 20*a* is shaped and sized to press fit transversely upon the outer edges 14*c* along the base surface of tubular track member 14. The open circular cavity of the clamp fitting 20*c* is shaped and sized to slide onto an end of the tubular chamber 14*a* and hold it in engagement. With the combined engagements of the end clip 20*a* on one side and the clamp fitting 20*c* on the other, the articulating end clip assembly 20 produces a flexible joint and connection between the tubular track members 14 that allows the support framework assembly 12 to be formed in a substantially rectangular configuration that is adjustable to conform to deviations in the shape of a particular window frame F. The flexible joints thus produced by the articulating end clip assemblies further allow the complete supporting framework assembly 12 to fold into a more collapsed state, as seen in FIG. 8, to store more easily. Ring members 20*b* projecting upward from the clamp fitting 20*c* are further included upon the articulating end clip assembly 20 and used in upper corners of the support framework assembly 12 to engage conventional hooks or tabs H, as shown in FIG. 1, that can be fastened to the window W in its upper corners to facilitate the mounting of the framework assembly and its removal and storage when desired. It should be noted and understood that while the articulating end clip assembly 20 is shown and described above in its assembled combination of component elements, a complete articulating end clip may also be replicated in construction as a single integrated member and used in accordance with the present invention.

Figure 9:
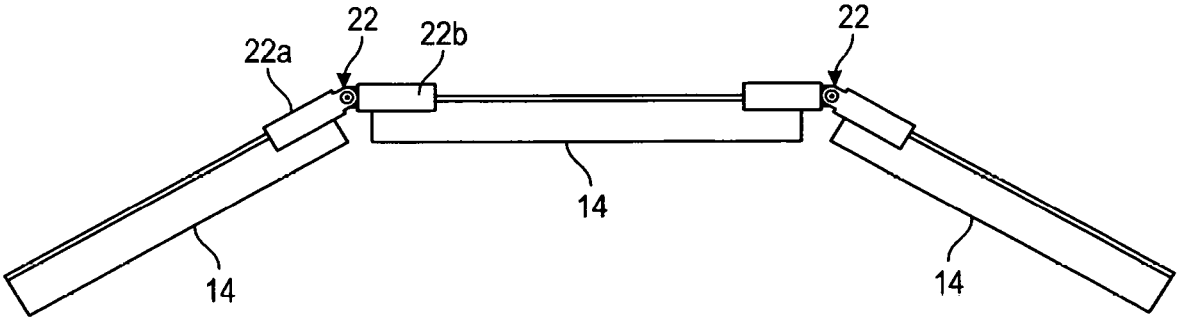
FIG. 9 is a depiction of an arched arrangement of tubular track members formed using a series of hinged coupler assemblies in accordance with the present invention.
Figure 10:
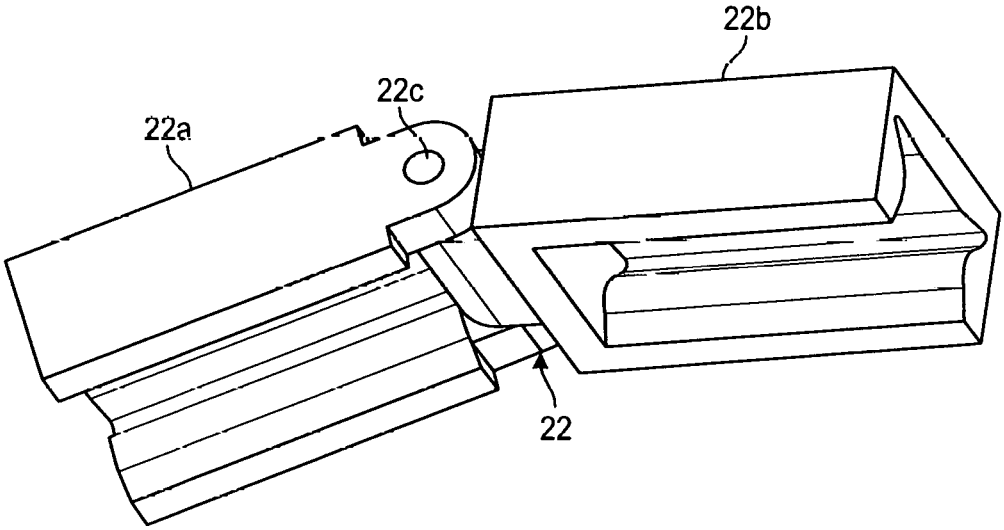
FIG. 10 is an enlarged perspective view of a hinged coupler assembly seen in FIG. 9.

Referring now to FIGS. 9 and 10, a modified form of the articulating end clip 20, here being referred to as a hinged coupler assembly 22, may be employed in accordance with the present invention to connect a linear series of tubular track members 14, here shown without decorative lights 18 mounted thereon, in order to create an extended frame pattern or configuration, different and apart from the traditional rectangular window frame, that will support the decorative lighting system 10 of the present invention. Such an alternate frame pattern or configuration would be useful in decorating window arches or those windows that have multi-sided frames that are pentagonal, hexagonal or octagonal in their shape. The hinged coupler assembly 22 includes a first and second coupler fitting 22*a* and 22*b*, respectively, pivotally connected together at an intermediate hinge joint 22*c*. The first and second coupler fittings 22*a*, 22*b* are each formed having an open rectangular cross-section configured to engage the base surface of tubular track member 14 similar to that of the end clip member 20*a*. The open rectangular cross-section of each coupler fitting 22*a*, 22*b* is shaped and sized to press fit transversely upon the outer edges 14*c* along the base surface of adjoining tubular track members 14, and the intermediate hinge joint 22*c* between them allows each of the track members to rotate relative to the other in the same plane and thereby provide a variety of framing configurations.

Therefore, it is apparent that the described invention generally provides an improved decorative lighting system for displaying an arrangement of decorative lights in and around windows of different sizes and configurations in a customized manner with maximum aesthetic appeal. More particularly, the present invention provides an improved decorative lighting system for customized mounting within a window frame that is better constructed and easier to assemble and mount than prior art window-mounted systems heretofore developed. The present invention further provides a window-mounted decorative lighting system constructed and assembled with an improved supporting framework that is more easily installed into any window frame and can be more readily removed without damaging the frame and stored with ease for subsequent installation. The present decorative lighting system with its improved supporting framework can more flexibly adjust to different shapes and more easily adjust the desired positioning of the lights in the resulting display to optimize the decorative effect and better complement the size and shape of the associated window. The present decorative lighting system and its supporting framework assembly are relatively inexpensive to manufacture and economical to produce, and maintain reliability of performance over extended periods of usage.

Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. Furthermore, certain modifications to the described embodiment that serve to benefit its usage are within the scope of the present invention. Accordingly, it is understood that this invention is not limited to the particular embodiment described, but rather is intended to cover modifications within the spirit and scope of the present invention as expressed in the appended claims.

What is claimed is:

1. A support framework for mounting a plurality of decorative lights with interconnecting electrical wiring upon a window frame, comprising:

a plurality of tubular track members, each integrally formed having a slotted chamber section extending longitudinally upon a base section having a squared outer edge projecting laterally along either side thereof to provide a flat planar surface along the base section beneath the slotted chamber section;

a plurality of articulating end clip assemblies, each end clip assembly comprising an end clip, an end clamp and an intermediate pivotal joint formed and assembled to engage the chamber section and base section of separate adjoining tubular track members and provide a flexible interconnection therebetween; and a plurality of light-mounting clips formed to transversely engage the squared outer edge and flat planar surface of the tubular track members for holding the decorative lights in selected positions along the track members.

2. A support framework for mounting decorative lights according to claim 1, wherein the slotted chamber section of the tubular track members is sized to hold the electrical wiring interconnecting the decorative lights.

3. A support framework for mounting decorative lights according to claim 1, wherein the articulating end clip assemblies further comprise one or more ring members projecting from the clamp fitting to facilitate mounted placement of the support framework upon the window frame and removal therefrom.

4. A support framework for mounting decorative lights according to claim 1, wherein:

the end clip of each articulating end clip assembly is formed having an open rectangular cross-section configured to transversely engage the base section along the tubular track member; and the clamp fitting is formed having a circular cavity open at the distal end thereof to engage the tubular chamber section of an adjoining tubular track member;

whereby the intermediate pivotal joint between the end clip and the clamp fitting allows the end clip and clamp fitting together with their respective engaged tubular track members to rotate relative to each other in the same plane.

5. A support framework for mounting decorative lights according to claim 4, wherein:

the open rectangular cross-section of the end clip is shaped and sized to press fit transversely upon the outer edges along the base section of the tubular track member; and the open circular cavity of the clamp fitting is shaped and sized to slide onto the tubular chamber in engagement therewith.

6. A support framework for mounting decorative lights according to claim 1, wherein each light-mounting clip is integrally formed comprising:

a base section formed for fitted engagement with the base sections of the tubular track members;

a neck section projecting from the base section at one end thereof;

a pad section projecting from the base section at the opposite end thereof; and a head section formed at the top of the neck section having an open cross-section sized and shaped to hold a decorative light.

7. A support framework for mounting decorative lights according to claim 6, wherein the neck section projects arcuately from the base section with a bowed contour and the pad section projects from the base section at an inclined angle to provide internal spaces at each end of the base section for fitted engagement with the base sections of the tubular track members.

8. A support framework for mounting decorative lights according to claim 6, wherein the open cross-section of the head section is varied in projected configuration thereof to hold decorative lights in different directions upon the tubular track members.

9. A support framework for mounting decorative lights according to claim 1, further comprising:

a hinged coupler assembly for pivotally connecting a linear series of the tubular track members into a selected framing configuration, the hinged coupler assembly including a pair of coupler fittings and an intermediate hinge joint therebetween, the coupler fittings each formed having an open rectangular cross-section configured to engage the base section of adjoining tubular track members with the intermediate hinge joint therebetween allowing the adjoining track members to rotate relative to each other in the same plane and thereby provide a variety of multi-sided framing configurations.

10. A support framework for displaying a wiring string of interconnected decorative lights upon a frame opening, comprising:

a plurality of tubular track members disposed horizontally and vertically, each integrally formed having a slotted longitudinal chamber section with a slot opening extending along the length thereof and a base section disposed beneath the slotted chamber section having an outer edge squared in cross-section projecting laterally on both sides to provide a flat planar surface beneath the slotted chamber section opposite to the slot opening;

a plurality of articulating end clip assemblies, each end clip assembly comprising an end clip, an end clamp and an intermediate pivotal joint formed and assembled to engage the chamber section and base section of separate adjoining tubular track members and provide a flexible interconnection therebetween; and a plurality of light-mounting clips formed to transversely engage the squared outer edge and flat planar surface of the tubular track members for holding the decorative lights in selected positions along the track members.

11. A support framework for displaying decorative lights according to claim 10, wherein the articulating end clip assemblies further comprise one or more ring members projecting from the clamp fitting to facilitate mounted placement of the support framework upon the frame opening.

12. A support framework for displaying decorative lights according to claim 11, wherein:

the end clip of each articulating end clip assembly is formed having an open rectangular cross-section configured to transversely engage the base section along the tubular track member; and the clamp fitting is formed having a circular cavity open at the distal end thereof to engage the tubular chamber section of an adjoining tubular track member;

whereby the intermediate pivotal joint between the end clip and the clamp fitting allows the end clip and clamp fitting together with their respective engaged tubular track members to rotate relative to each other in the same plane.

13. A support framework for displaying decorative lights according to claim 12, wherein:

the open rectangular cross-section of the end clip is shaped and sized to press fit transversely upon the squared outer edges along the base section of the tubular track member; and the open circular cavity of the clamp fitting is shaped and sized to slide onto the tubular chamber in engagement therewith.

14. A support framework for displaying decorative lights according to claim 10, wherein each light-mounting clip is integrally formed comprising:

a base section formed for fitted transverse engagement of the base of the tubular track members;

a neck section projecting from the base section at one end thereof;

a pad section projecting from the base section at the opposite end thereof; and a head section formed at the top of the neck section having an open cross-section sized and shaped to hold a decorative light.

15. A support framework for displaying decorative lights according to claim 14, wherein the neck section projects arcuately from the base section with a bowed contour and the pad section projects from the base section at an inclined angle to provide internal spaces at each end of the base section for fitted transverse engagement with the base of the tubular track members.

16. A support framework for displaying decorative lights according to claim 15, wherein the open cross-section of the head section is varied in projected configuration thereof to hold decorative lights in different directions upon the tubular track members.

17. A support framework for displaying decorative lights according to claim 16, wherein the slotted chamber section of the tubular track members is sized to hold the wiring interconnecting the decorative lights.

18. A support framework for displaying decorative lights according to claim 10, further comprising:

a coupler assembly for pivotally connecting a series of the tubular track members into a multi-sided configuration, the hinged coupler assembly including a pair of coupler fittings and an intermediate hinge joint therebetween, the coupler fittings each formed having an open rectangular cross-section configured to engage the base section of adjoining tubular track members with the intermediate hinge joint therebetween allowing the adjoining track members to rotate relative to each other in the same plane.

* * * * *